US005803756A

United States Patent [19]

Furutani et al.

[11] Patent Number: 5,803,756

[45] Date of Patent: Sep. 8, 1998

[54] ELECTRICAL CONNECTOR WITH SHORT CIRCUIT TERMINAL

[75] Inventors: Mitsugu Furutani; Takatoshi Katsuma; Masaaki Tabata, all of Yokkaichi, Japan

[73] Assignee: Sumitomo Wiring Systems, Ltd., Japan

[21] Appl. No.: 689,469

[22] Filed: Aug. 8, 1996

[30] Foreign Application Priority Data

Aug. 8, 1995 [JP] Japan ..... 7-224733
Aug. 8, 1995 [JP] Japan ..... 7-224736

[51] Int. Cl.[6] ..... H01R 29/00

[52] U.S. Cl. ..... 439/188; 439/752; 200/51.1

[58] Field of Search ..... 439/188, 595, 439/752; 200/51.1, 51.12

[56] References Cited

U.S. PATENT DOCUMENTS

| | | | |
|---|---|---|---|
| 3,713,080 | 1/1973 | Kennedy | 439/852 |
| 4,904,196 | 2/1990 | Sueyoshi et al. | 439/188 |
| 5,263,872 | 11/1993 | Marpoe et al. | 439/188 |
| 5,277,608 | 1/1994 | Oda | 439/188 |

FOREIGN PATENT DOCUMENTS

| | | | |
|---|---|---|---|
| 0 389 779 | 2/1990 | European Pat. Off. | H01R 13/703 |
| 40 41 060 | 6/1991 | Germany | H01R 13/703 |
| U 9112178.7 | 7/1992 | Germany | H01R 13/703 |
| 43 42 820 | 6/1994 | Germany | H01R 13/703 |
| 5-290917 | 11/1993 | Japan | H01R 13/42 |
| 2248350 | 4/1992 | United Kingdom | H01R 13/436 |

*Primary Examiner*—Neil Abrams
*Assistant Examiner*—T. C. Patel
*Attorney, Agent, or Firm*—Banner & Witcoff, Ltd.

[57] ABSTRACT

A short circuit connector has male and female connector housings 10,20, one of which has a short circuit terminal 30 and the other of which has an insertion member 16. In the disconnected state the short circuit terminal 30 electrically connects two terminals of one housing, whilst in the connected state the short circuit terminal 30 is disengaged by the insertion member 16. The insertion member does not directly separate the contact area of the terminals. In a second aspect the connector includes a retainer 117 which has retention projections 124,127 engageable in the chamber of the short circuit terminal; separate engagement recesses are thereby avoided.

19 Claims, 8 Drawing Sheets

ELECTRICAL CONNECTOR WITH SHORT CIRCUIT TERMINAL

TECHNICAL FIELD

The present invention relates to connectors in which terminals of one the connector housings are short circuited when two mutually fitting connector housings are separated, and to a retainer for a connector.

BACKGROUND TO THE INVENTION

Short circuit connectors are used, for example, in circuits for the operation of air bags in automobiles. When the air bag is removed, for maintenance and so on, the connector housings must be separated and the electrical circuit re-arranged so that the terminal fittings on one of the connector housings are short circuited so as to prevent detonation or malfunction of the air bag.

The specific configuration of the connectors is as follows. One of the connector housings, among the pair of connector housings having mutually connectable connection terminals, has a short circuiting terminal that resiliently makes contact with the external face of a connection terminal. The other connector housing has an insulating member that is inserted between the connection terminal and the short circuiting terminal as the connector housings are fitted together.

When the connector housings are in a separated state, the short circuiting terminal makes resilient contact with the connection terminal and thereby short circuits the connection terminal. Thus the air bag electrical circuit is short circuited when it is disconnected from the vehicle electrical system, and this ensures that accidental detonation triggered by an open circuit is avoided.

In the case of a conventional short circuit connectors, when both the connector housings are fitted together, the insulating member engages directly with the short circuiting terminal and forces it to bend resiliently, as it forcibly enters the space between the short circuiting terminal and the connection terminal.

There is a possibility of the anterior end of the insulating member colliding with the anterior end of the short circuiting terminal, thereby adversely affecting the fitting of the connector housings and producing an abnormal change in shape of the short circuiting terminal.

Furthermore, if a sliver of material is shaved from the insulating member it may prevent a short circuit occurring when the insulating member is removed.

Conventional connectors often have a retainer to make certain that a terminal inserted into a terminal insertion chamber of a connector housing is unremovable. When the terminal fitting is inserted into the terminal insertion chamber, it is first stopped by means of a resilient member referred to as a lance. After that, the retainer is fixed in the housing and a portion of the retainer doubly stops the terminal so that removal of the terminal is prevented with certainty.

Normally, the retainer has two stopping positions with respect to the housing. One of these is referred to as a temporary stopping position and is a position whereby the terminal fitting is freely removable. The other position is located deeper than the temporary stopping position and is referred to as a main stopping position. In order to make such a stopping possible, one or more stopping members are provided on the retainer and are resiliently engageable in one of two recesses to hold the retainer in either the temporary or main stopping position.

However, conventionally, the recesses are specially provided in the housing and, as a result, the connector as a whole becomes large. This in turn increases cost of materials which has an adverse effect on production cost.

The present invention has been developed taking these problems into consideration. In a first aspect the invention aims to ensure that the insulating member enters with certainty between the short circuiting terminal fitting and the connection terminal fittings, and in a second aspect, aims to miniaturise the connector and retainer.

SUMMARY OF THE INVENTION

According to a first aspect of the invention there is provided an electrical connector assembly comprising a first connector having a first terminal, and a short circuit terminal biased into electrical contact at a contact point with said first terminal, and a second connector having a second terminal for connection with said first terminal and an insertion member for insertion between the short circuit terminal and first terminal in an insertion direction to break electrical contact therebetween, characterized in that the short circuit terminal has an abutment spaced from the contact point for engagement by a first part of the insertion member to separate the contact point and the first terminal, a second part of the insertion member being of insulative material and movable between the contact point and first terminal when separated.

In the invention a space between the short circuiting terminal and the connection terminal is opened up, and after that the insulating member enters between the short circuiting terminal and the connection terminal. Accordingly, separation of the short circuit terminal and interposition of the insulating member between the short circuit terminal and the connection terminal are no longer combined as a single function. This gives less likelihood of abnormal deformation of the terminal or undue friction.

Preferably the contact member is in resilient contact with the first terminal and is formed of an electrically conductive material.

The contact member may have spaced legs, one leg being mounted on a support surface, and the other leg has said contact point and projection.

The projecting part of the insertion member is preferably tapered so as to gradually urge the short circuit terminal away from said first terminal.

According to a second aspect of the invention an electrical connector assembly comprises a housing having a terminal insertion chamber for the insertion of a terminal, an accessory attachment member having an accessory related to the connector, a retainer insertion hole extending between the accessory attachment member and the terminal insertion chamber; and a retainer for supporting a terminal in a non-removable state by fitting therewith, the retainer being arranged to be insertable into the retainer insertion hole and having a stopping member formed thereon, the stopping member being adapted to engage the accessory attachment member.

Preferably the retainer and retainer insertion hole have control means to ensure correct orientation; the control means may be a projection and corresponding recess.

The accessory attachment member may be an integral part of the connector housing, and in the preferred embodiment is the short circuit connector part of an air bag connector. Such a connector part necessarily has apertures to receive and retain the short circuit terminal, and these apertures may be used in a secondary way to provide engagement surfaces for the retainer. The retainer may comprise intermediate latching means for latching the retainer to the connector in an inactive position to allow the insertion of a terminal into the connector, the retainer being subsequently movable to an active condition in which the terminal is retained.

Other features of the invention will be apparent from the following description of several preferred embodiments, shown by way of example in the accompanying drawings in which:

DESCRIPTION OF PREFERRED EMBODIMENT

Figure 2:
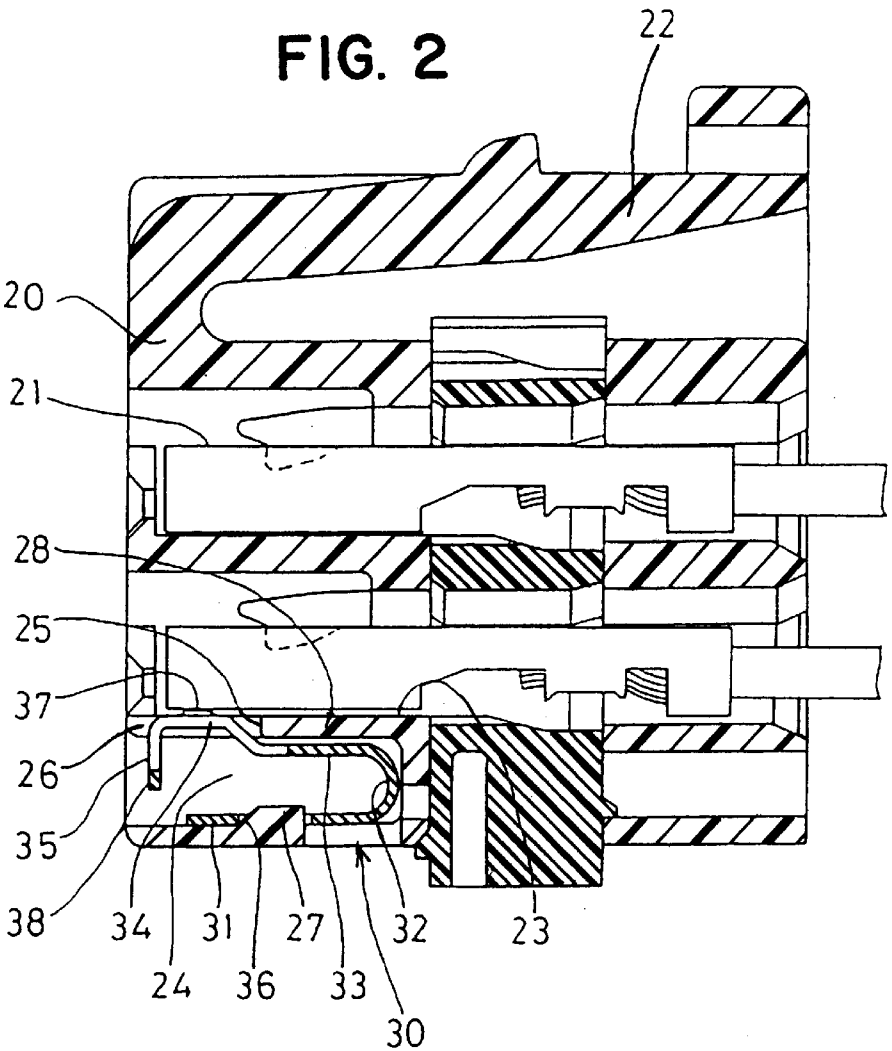
FIG. 2 is a cross-section through a female connector housing of the first embodiment.
Figure 1:
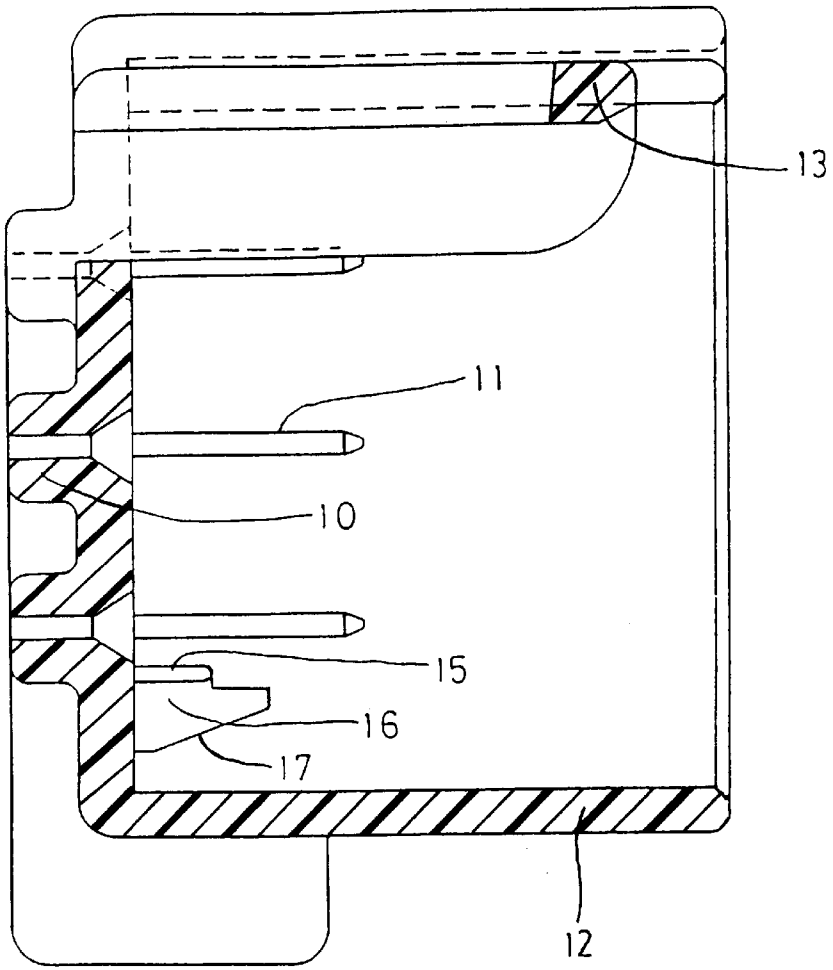
FIG. 1 is a cross-section through a male connector housing of a first embodiment of the present invention.
Figure 3:
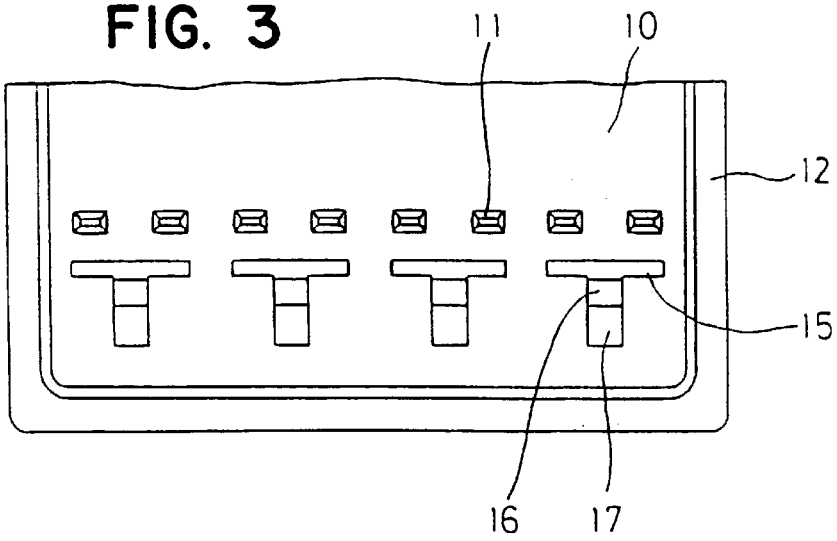
FIG. 3 is a partial front view of the male connector housing of FIG. 1.
Figure 4:
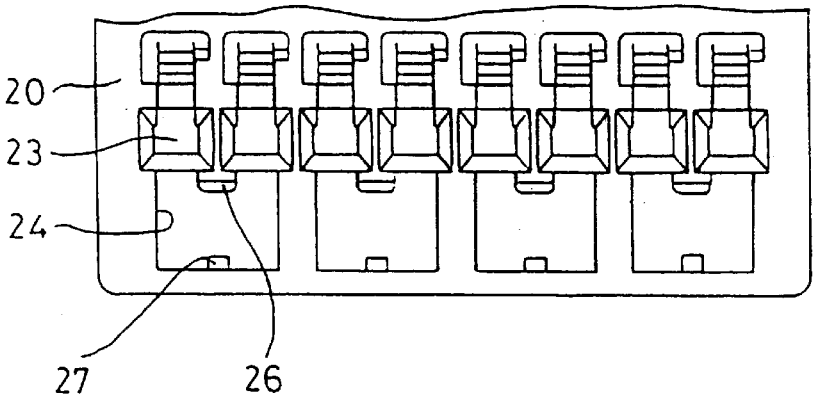
FIG. 4 is a partial front view of the female connector housing of FIG. 2.
Figure 8:
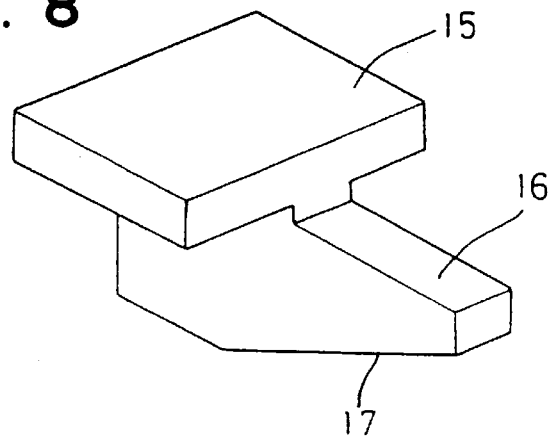
FIG. 8 is a diagonal view of the insulating member of the first embodiment.
Figure 5:
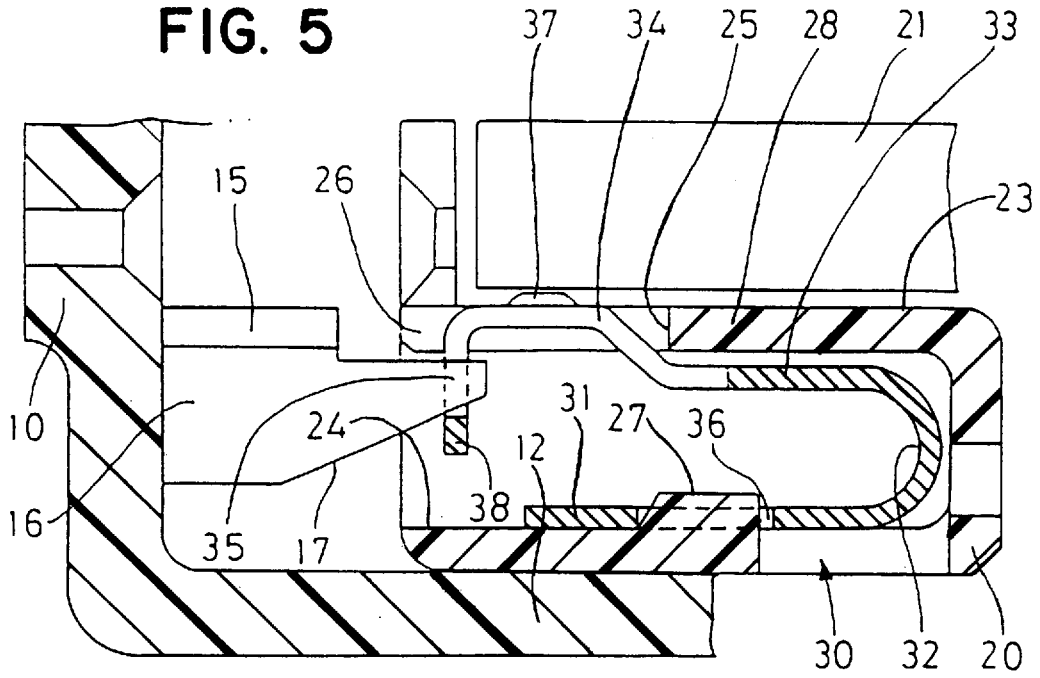
FIG. 5 is a partial, enlarged cross-sectional view of an intermediate stage in the fitting of the male and female connector housings of the first embodiment.
Figure 6:
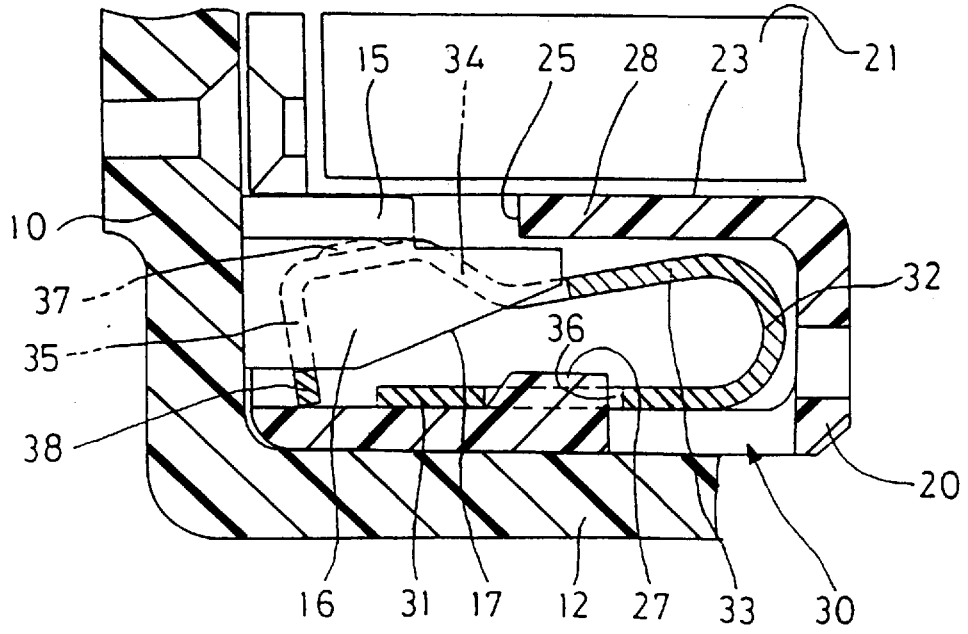
FIG. 6 is a partial, enlarged cross-sectional view of the final stage in the fitting of the male and female connector housings of the first embodiment.
Figure 7:
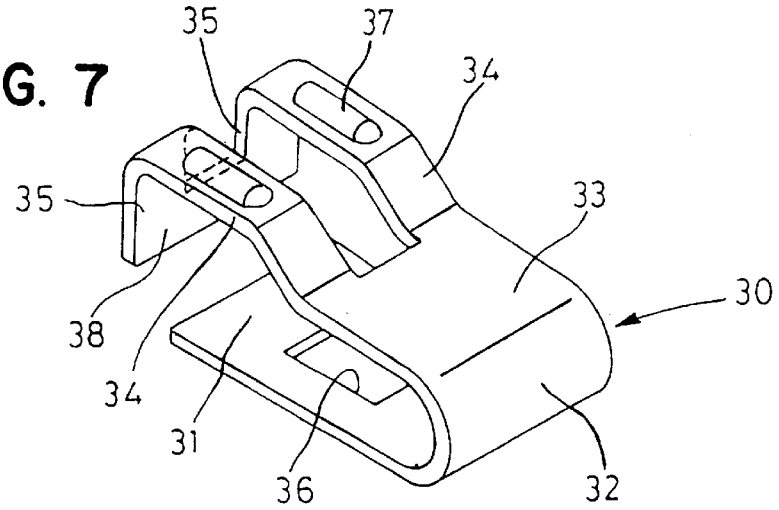
FIG. 7 is a diagonal view of the short circuiting terminal fitting of the first embodiment.

An embodiment of the first aspect of the present invention is now explained with reference to FIGS. 1 to 8.

Connectors of the present invention comprise a male connector housing 10 and a female connector housing 20 that fit mutually with each other. The connector housings 10 and 20 have a plurality of mutually connectable male connection terminals 11 and female connection terminals 21. The male connector housing 10 has a hood member 12. When the female connector housing 20 is fitted into this hood member 12, a locking arm 22 located on the upper face of the female connector housing 20 fits with a projection 13 located on the upper face of the hood member 12, and thus both the connector housings 10 and 20 can be latched with the male terminals 11 and the female terminals 21 electrically connected.

Eight of the female connection terminal fittings 21 located on the lowermost level form four pairs. When both the connector housings 10 and 20 are in a separated state, each of the pairs of the female connection terminal fittings 21 are short circuited; when both the connector housings 10 and 20 are in a fitted state, the short circuiting of each of the pairs of the female connection terminal fittings 21 is released.

The female connector housing 20 has four chambers constituting short circuiting terminal insertion chambers 24 located so as to extend across a pair of cavities 23 and located below the lowermost level of cavities 23. An upper face wall 28 of each of the chambers 24 has connecting holes 25 that respectively connect with the anterior ends of the two cavities 23. Furthermore, a rib 26 is formed between these connecting holes 25 on a portion of the upper face wall 28. The lower face of the chamber 24 has a supporting projection 27 for fixing the position of the short circuiting terminal 30.

The short circuiting terminal 30 (FIG. 7) is formed by bending electrically conducting metal material, and consists of: a flat base plate member 31 that makes contact with the lower face of the chamber 24; a member 32 that is bent upwards from the posterior end of the base plate member 31 so as to be approximately semi-circular; a supporting member 33 that extends in an anterior direction from the upper end of the bent member 33; mutually parallel contact members 34 that first extend diagonally upwards after being separated into two levels from the anterior end of the supporting member 33, and then become parallel to the base plate member 31; and overhanging members 35 that extend downwards from the anterior ends of the contact members 34.

The base plate member 31 has an attachment hole 36 into which is fitted the supporting projection 27 to fix the position of the terminal 30. Since there is almost no space between the supporting member 33 and the upper face wall 38, the removal of the short circuiting terminal fitting 30 is thus prevented. In the free state, the two contact members 34, pass through the connecting holes 25 into the cavities 23. The upper face of each of the contact members 34 has a boss 37 formed thereon which projects slightly into the cavity 23 and thereby makes contact with the female connection terminals 21. The anterior ends of the overhanging members 35 are connected to link members 38. An insertion member 16, to be described later, fits with this link member 28.

When the connectors 10 and 20 are separated, the boss 37 of each contact member 34 makes contact with the lower face of each adjacent female terminal 21. The female terminals forming a pair inside the adjacent cavities 23 are short circuited.

When the connector housings 10 and 20 are fitted together, the short circuiting terminal fitting 30 bends downwards due to the insertion member 16 until the contact members 34 are disengaged from the connecting holes 25. As a result, the short circuiting terminal 30 separates from the two female terminals 21.

The male connector housing 10 has four resilient members 16 having insulating members 15 and inducing members 17 formed thereon. These face each of the short circuiting terminals 30 from the interior end face of the hood member 12.

The insulating member 15 is a horizontal, thin plate (parallel to the upper face wall 28 of the short circuiting chambers 24). In the fitted state of both the connector housings 10 and 20, the insulating member 15 enters the chamber 24 along the lower face of the upper face wall 28.

The projection length of this insulating member 15 is set so that it covers the boss 37. Furthermore, the width thereof is set so as to correspond to the female terminals 21 which form a pair; consequently, one insulating member 15 enters between the pairs formed respectively by the female connection terminals 21 and the contact members 34.

The inducing member 17 projects from the interior end face of the hood member 12, and is formed so as to extend downwards from the center of the lower face of the insulating member 15. The projection length of the inducing member 17 is such that it projects beyond the insulating member 15. Accordingly, when the connector housings 10 and 20 are being fitted together, the anterior end of the inducing member 17 reaches the short circuiting terminal fitting 30 before the anterior end of the insulating member 15. The inducing member 17 has a width-wise dimension so as to enter between the contact members 34.

The lower face of the inducing member 17 is a diagonal and rises upwards as it approaches its anterior end and inclines towards the fitting direction of the connectors 10 and 20. The height of the anterior end of the inducing member 17 is set to be higher than the height of the upper edge of the link member 38 when the short circuiting terminal 30 is in a free state. Furthermore, the height of the lowest portion of the interior end face of the hood member 12 is set to be lower than the upper edge of the link member 38. Consequently, when the connector housings 10 and 20 are fitted together, the inducing member 17 fits with the link member 38 and pushes the link member 38 downwards.

Operation of the present embodiment is now explained. When the connector housings 10 and 20 are in a separated state, each short circuiting terminal 30 is in a free state and the two contact members 34 make elastic contact with the female connection terminals 21, which form a pair. Consequently, these female connection terminal fittings 21 are short circuited.

When the connector housings 10 and 20 are fitted together, the anterior end of the insertion member 16 reaches the short circuiting terminal fitting 30 before the insulating member 15. The inducing member 17 fits with the link member 38 which bends resiliently downwards due to the incline of the inducing member 17. As a result a space opens up between the contact member 34 and the upper face wall 28, and the insulating member 15 enters therein.

As explained above, in the present embodiment, even though the insulating member 15 does not fit directly with the short circuiting terminal 30, a space opens up between the short circuiting terminal 30 and the female connection terminal fitting 21. The insulating member 15 enters this space. Consequently, the insulating member 15 can be inserted between the short circuiting terminal 30 and the female connection terminal 21 with certainty.

Figure 9:
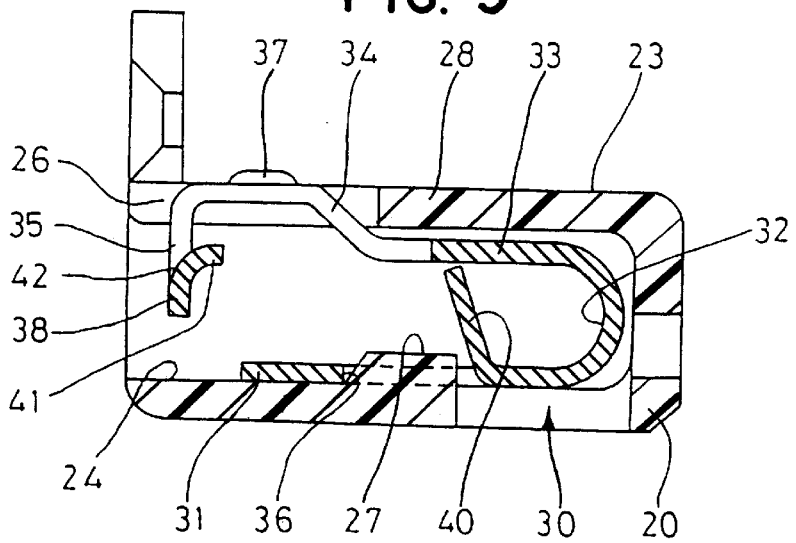
FIG. 9 is a partial, enlarged cross-sectional view of a second embodiment.

A second embodiment of the present invention is illustrated in FIG. 9 and has an excessive bending preventing member 40 and a sliding face 42 provided on the short circuiting terminal 30 of the first embodiment. In all other respects, the configuration of the second embodiment is the same as that of the first embodiment. Accordingly, the same numbers are accorded to each member of the present embodiment that is common to the first embodiment, and an explanation of the structure, operation and effects thereof is omitted.

An attachment hole 36 in a short circuiting terminal 30 of the present embodiment is formed by cutting a portion of a base plate member 31 upwards. The portion cut away in order to form this attachment hole 36 forms the excessive bending preventing member 40 which rises upwards in an anterior diagonal direction towards the lower face of the supporting member 33. If something is inserted into a short circuiting chamber 24 and pushes the short circuiting terminal 30 strongly in a downward direction, excessive bending of the short circuiting terminal fitting 30 beyond its limit of elasticity is prevented due to contact with the member 40.

Furthermore, the curved projection member 41 is formed so as to project upwards in a posterior direction and form a sliding face 42. By providing the sliding face 42 in this manner, the fitting of the insertion member 16 is smooth.

Figure 10:
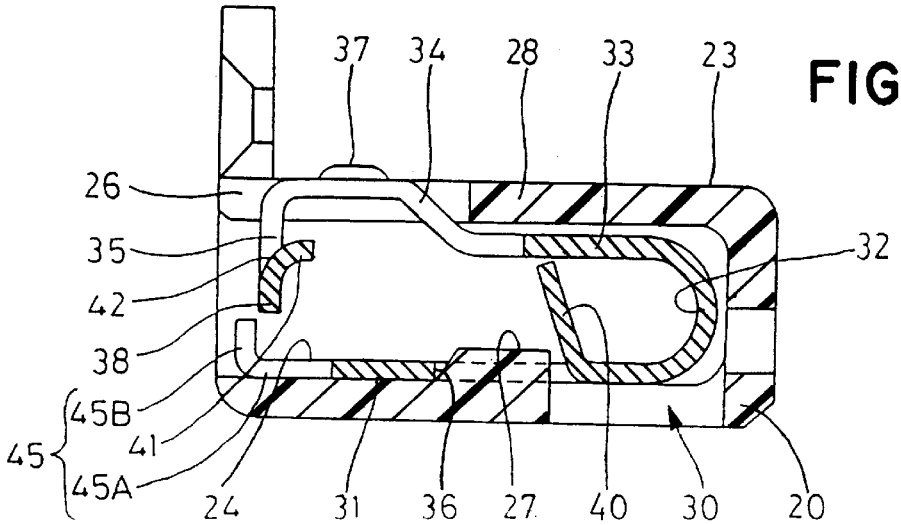
FIG. 10 is a partial, enlarged cross-sectional view of a third embodiment.

A third embodiment of the present invention is illustrated in FIG. 10.

The third embodiment has a pair of anti-entanglement members 45 provided on the short circuiting terminal fitting 30 of the second embodiment. In all other respects, the configuration of the third embodiment is the same as that of the second embodiment. Accordingly, the same numbers are accorded to each member of the present embodiment that is common to the second embodiment, and an explanation of the structure, operation and effects is omitted.

The anti-entanglement members 45 provided on the short circuiting terminal fitting of the present embodiment comprise projecting members 45A that extend from left and right portions of the base plate member 31, and rising members 45B that rise upwards from the anterior ends of the projecting members 45A. This pair of members 45 are located to the left and right so as to face the pair of overhanging members 35. As a result, the space between the members 45 is the same as the space between the overhanging members 35, this space being of such a dimension as to allow the insertion of an insertion member 16. Moreover, the rising members 45B of the members 45 are located so as to be more to the front than the link member 38 connected to the overhanging members 35. These members 45B and 35 are offset so as not to prevent bending of the short circuit terminal.

By providing the members 45, a large opening is no longer formed towards the anterior face of the short circuiting terminal, and as a result, when a large number of short circuiting terminal fittings 30 are contained in a reservoir for supply to the female connector housing 20 in a parts feeder, it becomes much more difficult for the short circuiting terminals 30 to become entangled.

Furthermore, as the fitting of the two connectors 10 and 20 proceeds, the insertion member 16 enters between the overhanging members 35 and the space between the pair of members 45; as a result, interference between the insertion member 16 and the members 45 is prevented. Moreover, if the short circuiting terminal fitting 30 bends downwards elastically, damage to the elastic bending due to the interference of the short circuiting terminal 30 with the members 45 is prevented due to the fact that the rising members 45B are located more to the front than the link member 38.

The present aspect of the invention is not limited to the embodiments described above. For example, the possibilities described below also lie within the technical range of the present invention. Moreover, the first aspect of the invention may be embodied in various ways other than those described below without deviating from the scope of the claims hereof.

In the above embodiments, a case was described wherein an insertion member 16 has an inducing face formed thereon in a diagonal direction with respect to the fitting direction of the connector housings 10 and 20, this configuration serving as a means for elastically changing the position of the short circuiting terminal 30 in the direction of removal from the connection terminals 21. However, it may equally be arranged so that the inducing face is provided on a link member of the short circuiting terminal.

In the second and third embodiments described above, a case was described where both the excessive bending preventing member 40 and the sliding face 42 are provided; however, according to the present invention it may equally be arranged so that only one of the two is provided.

Another aspect of the invention is illustrated with respect to FIGS. 11–18.

Figure 18:
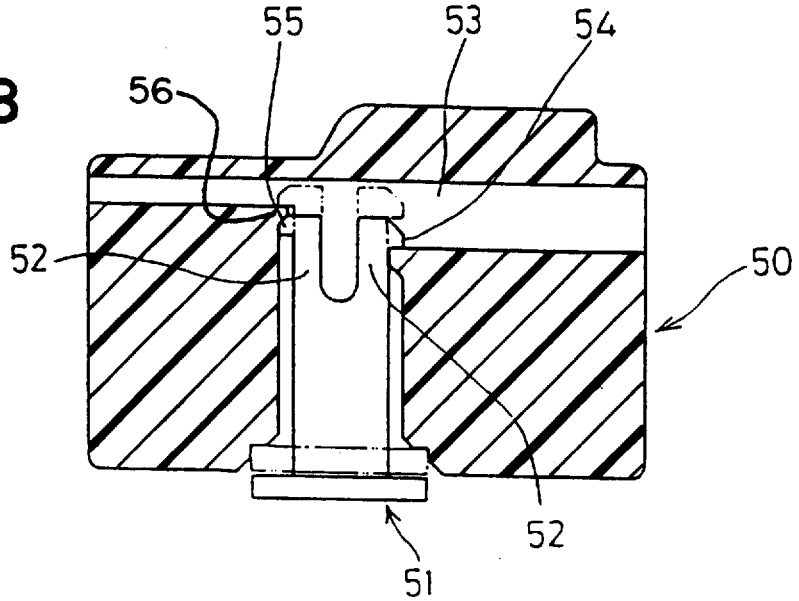
FIG. 18 PRIOR ART
FIG. 18 is a cross-section showing the stopping states of a conventional retainer.

FIG. 18 illustrates a conventional retainer of a connector assembly. A housing 50 is adapted to receive a terminal (not shown) which is usually retained by a resilient lance. A retainer 51 is insertable in an aperture of the housing 50 to engage and doubly stop the terminal against removal. The retainer has the second function of ensuring that the terminal is fully inserted, for if it is not the retainer itself is not insertable.

The retainer has resilient arms 52 having a respective projections 54,55 engageable in a stepped recess 53. In the temporary position shown in chain dot outline, the retainer is loosely fitted in the housing, and does not interfere with insertion of a terminal for engagement by the lance. The projection 54 engages within the recess 53 whilst the projection 55 engages an abutment 56.

The resilience of arms 52 permits the retainer to move to the main stopping position (in which the terminal is doubly stopped), shown in chain dot outline, and the projection 55 moves over abutment 56 to engage recess 53.

Such a construction is space consuming since the housing must be provided with means for engaging the retainer in both temporary and main stopping positions, for example one or more apertures additional to those normally provided in a connector housing.

An embodiment of the second aspect of the invention is explained hereinbelow, with reference to FIGS. 11 to 17.

Figure 11:
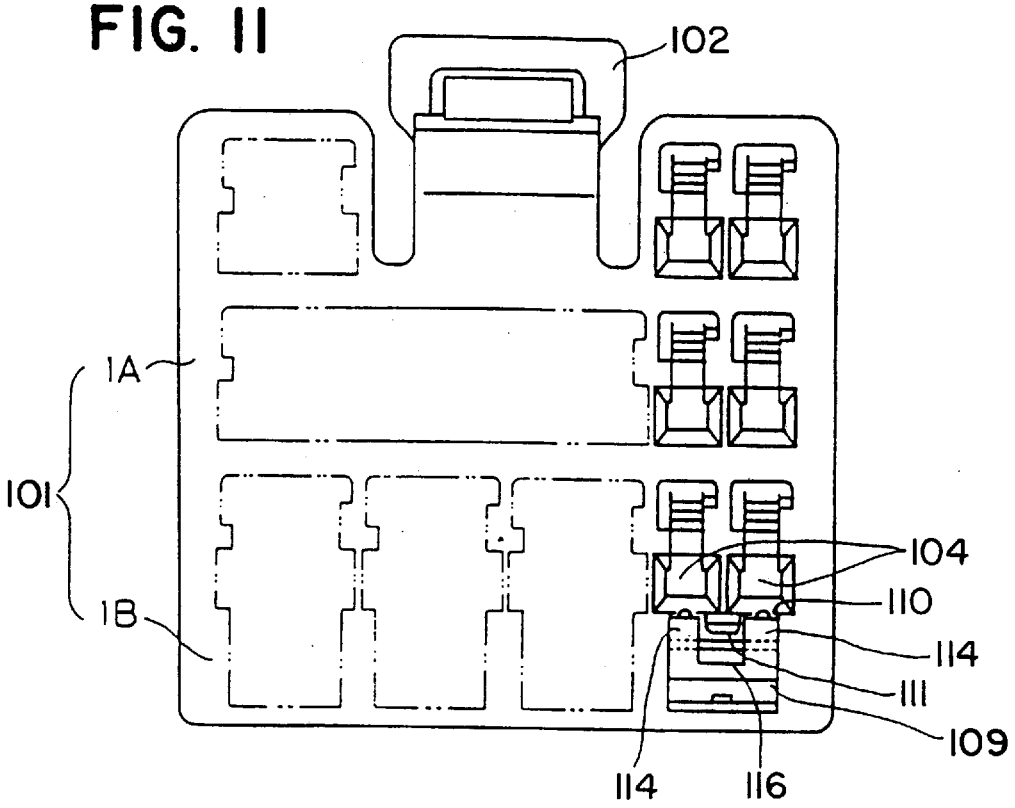
FIG. 11 is a front view of a connector housing.
Figure 12:
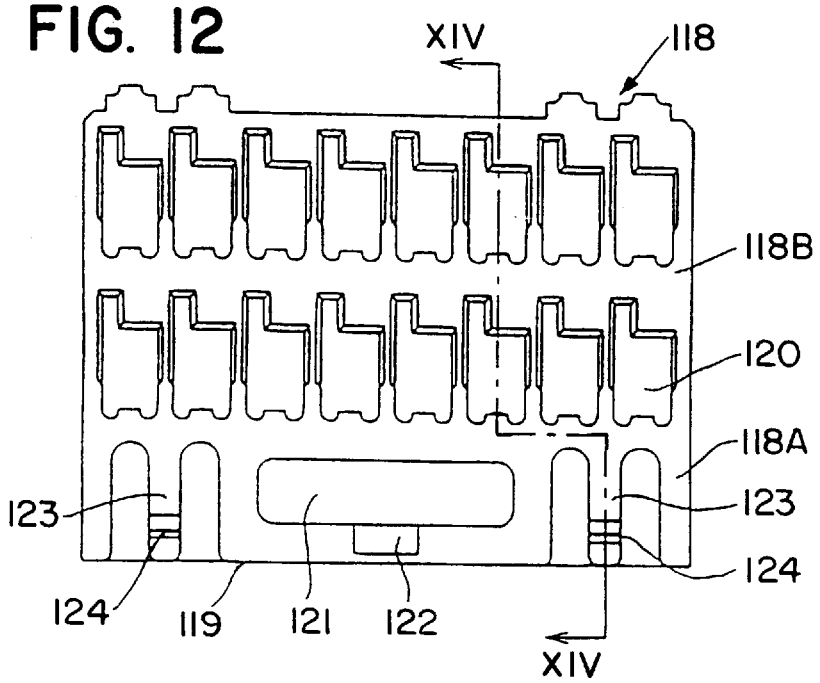
FIG. 12 is a front view of a retainer.
Figure 13:
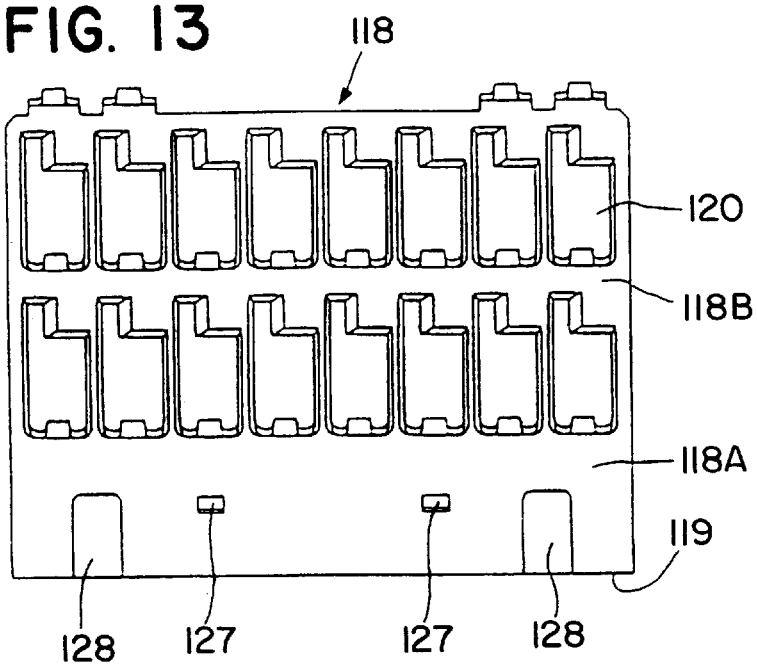
FIG. 13 is a rear view of the retainer.
Figure 14:
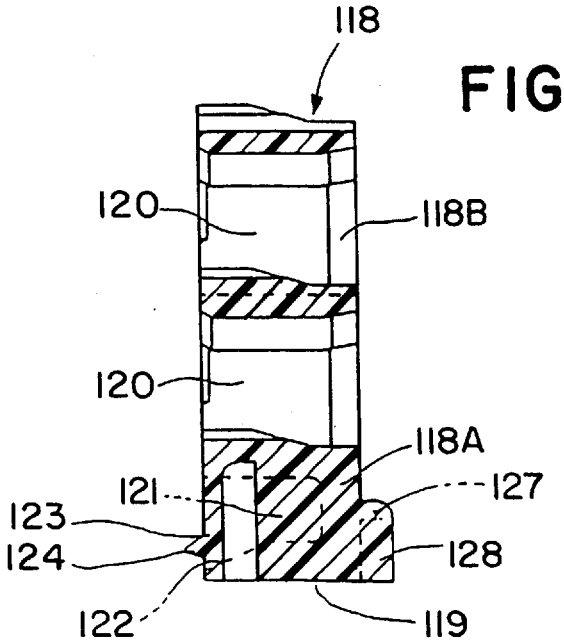
FIG. 14 is a cross-section along the line XIV—XIV in FIG. 12.

FIG. 11 shows a female air bag connector housing 101 having a bendable locking arm 102. Female and male connector housings are fitted together, the locking arm being for engagement with a stopping member formed on the corresponding male connector housing.

The female connector 101 has a plurality of terminal insertion chambers 104 formed along the axial direction of the housing 101 to receive terminal fittings 103. A bendable lance 105 is formed in each chamber 104 to retain a female terminal fitting 103.

The upper part of the housing 101 constitutes a terminal insertion member 1A for the insertion of the female terminal fittings 103. The lower part constitutes an accessory attachment member 1B for inserting short circuiting terminal fittings 106 (previously described) which serve to short circuit paired female terminal fittings 103. The upper and lower parts are connected in a vertical direction, as illustrated.

Figure 15:
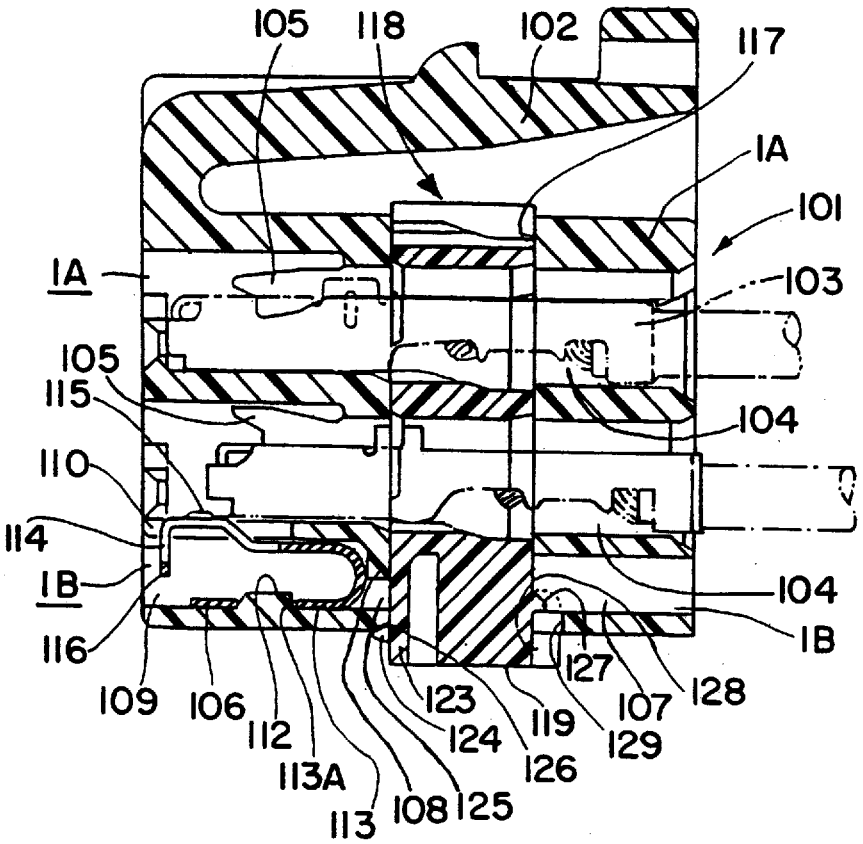
FIG. 15 is a cross-section showing a temporary stopping position of the retainer.
Figure 16:
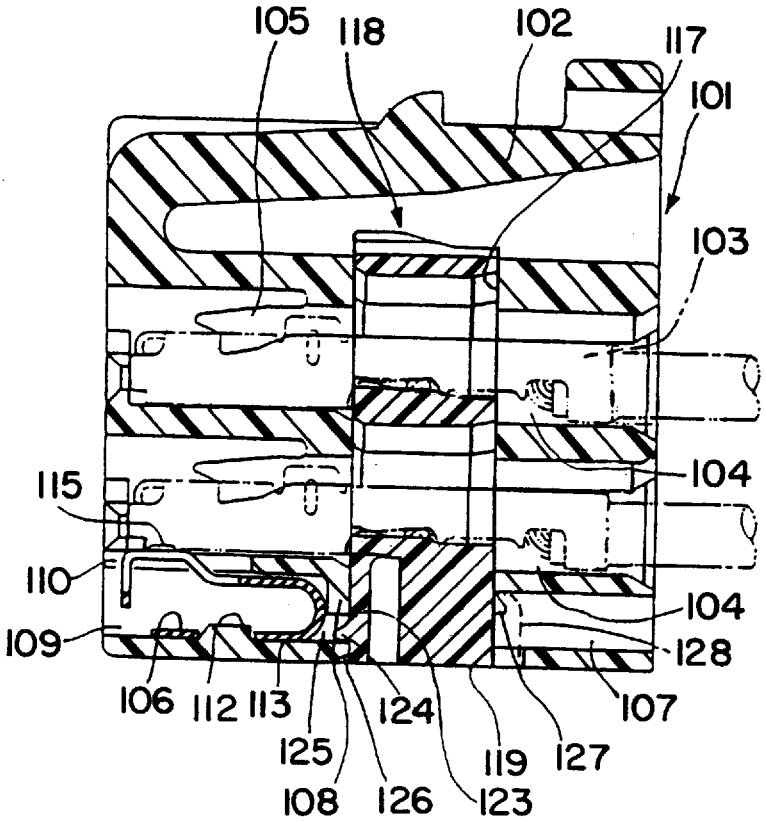
FIG. 16 is a cross-section showing a main stopping position of the retainer.
Figure 17:
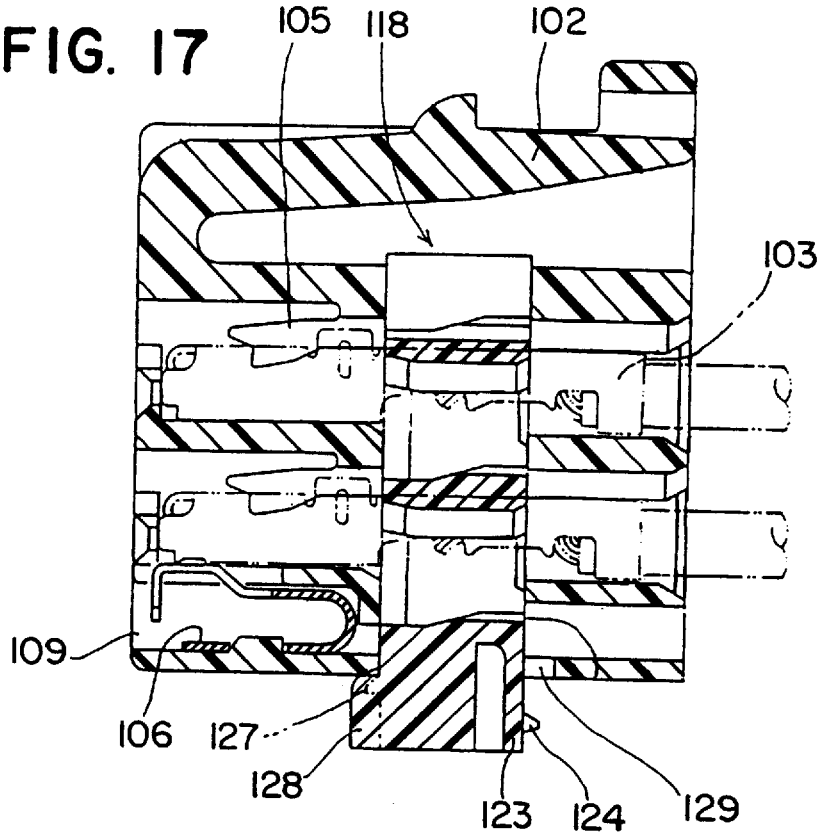
FIG. 17 is a cross-section showing a state whereby the retainer is inserted in a reversed manner.

The accessory attachment member 1B has four spaces 107 formed along the axial direction of the housing 1 and below the terminal insertion chambers 104. The empty spaces 107 span two of the insertion chambers 104. Each space 107 has a separating wall 108 located approximately in the center which separates the interior of the space 107 into anterior and posterior portions. As shown in FIG. 15, each of the chambers on the left-hand side forms the short circuiting terminal fitting insertion chamber 109. The insertion chambers 109 have position fixing projections 112 for fixing the position of the short circuiting terminal fittings 106.

A retainer insertion hole 117 is formed in the female housing from the lower face of the accessory attachment member 1B at a location posterior to the separating wall 108. The retainer insertion hole 117 is formed so as to be perpendicular to the axial direction of the housing 101, and extends up to the lower face side of the locking arm 102.

The retainer 118 is formed so as to be insertable into the retainer insertion hole 117 and has a lower pressing face 119. The retainer 118 comprises a base member 118A that corresponds to the accessory attachment member 1B, and a terminal stopping member 118B which corresponds to the terminal insertion member 1A and which prevents the terminal fittings 103 from being removed.

The terminal stopping member 118B has connecting windows 120 that correspond to the terminal insertion chambers 104. A portion of the female terminal fitting 103 fits with the end portion of each connecting window 120, thereby holding the female terminal fitting 103 in an unremovable state. Further, the base member 118A has means for ensuring that the retainer 118 is supported in two positions.

A concave member 121 extends inwards from the central portion of the front face (in the example shown in FIG. 12) of the base member 118A. The central lower end of the concave member 121 has an upwardly rising inclined face 122. A pair of foot members 123 is provided on the two sides of the concave member 121. The periphery of each foot member 123 is cut away from both sides up to the rear end. Accordingly, each foot member 123 as a whole is resilient and bendable.

A main stopping projection 124 is formed on the extreme anterior end of each foot member 123. This main stopping projection 124 fits resiliently with a hole 125 formed in the separating wall 108 when the retainer 118 is inserted up to the correct depth with respect to the retainer insertion hole 117. Moreover, the hole 125 is provided in order to insert from one end (the posterior end with respect to the diagram) a moulded pin (not shown) that constitutes the position fixing projection 112. In the present embodiment, the main stopping function is made possible by utilizing this hole which is necessary for other reasons. When the retainer 118 is in the temporary stopping position (see FIG. 15), the main stopping projection 124 makes contact with a guiding inclined face 126 that is formed on a location corresponding to the open end side of the lower face of the retainer insertion hole 117.

A pair of temporary stopping projections 127 are formed on the lower part of the rear face of the retainer 118 (shown in FIG. 13), in a position that corresponds to that of the concave members 121. The temporary stopping projections 127 respectively fit with the open ends of the spaces 107 of the retainer insertion hole 117 when the retainer 118 is inserted up to a specified depth. As a result, the retainer 118 is supported in the temporary stopping position.

A pair of controlling convex members 128 is provided on the base member 118A in a position further to the outside with respect to the position where the two temporary stopping projections 127 are located. These controlling convex members 128 prevent the reverse insertion, i.e., a back to front insertion, of the retainer 118. Both the controlling convex members 128 are arranged to be insertable into the spaces 107 via a pair of concave recesses 129 formed on a location corresponding to a posterior side of the open end side of the lower face of the retainer insertion hole 117. As shown in FIG. 15, in the temporary stopping position a portion of the controlling convex member 128 comes close to the space 107, and in the main stopping position the controlling convex member 128 uniformly enters the space 107. If the retainer 118 is reversed back to front, both the convex members 128 collide with an anterior side of the open end side of the lower face of the retainer insertion hole 117, thereby preventing insertion from proceeding any further.

In use the retainer 118 is temporarily stopped in the housing 101 before the insertion of the terminal fitting. The female terminal fittings 103 are inserted from the posterior end of each of the terminal insertion chambers 104 after which each female terminal fitting 103 fits resiliently with the lance 105 and is stopped. Along with this, the lower faces of the female terminal fittings 103, which form pairs at the lowermost level, make contact with a boss 115 of the short circuiting terminal fitting 106. FIG. 15 illustrates the lower terminal fitting 103 in a partially inserted state with the lance 105 bent upward.

When the retainer 118 is pressed further in, it fits with each female terminal fitting 103, and in this manner, the female terminal fittings 103 are held strongly in an unremovable condition. At this juncture both the foot members 123 bend and the main stopping projections 124 resiliently fit with the respective holes 125.

In the state where the female terminal fitting 103 is not inserted up to the correct depth (the half-fitted position), the retainer 118 collides with the female terminal fitting 103 (FIG. 15) and cannot be inserted up to the correct depth. This informs the operator that the female terminal fittings 103 are half-inserted.

As explained above, in the present embodiment, the accessory attachment member 1B is used for inserting the short circuiting terminal fittings 106 which are necessary for connectors used in air bags, the accessory attachment member 1B also serving as a member for stopping the retainer 118 in the housing. In other words, since a previously existing member is used to carry out the stopping of the retainer 118, there is no longer any need to provide a special member for stopping, which facilitates miniaturization of the housing 118.

Moreover, the use of the holes 125 as a means provided on the housing side for carrying out the main stopping also contributes to miniaturization.

Furthermore, in the present embodiment, since the controlling convex members 128 are provided in order to prevent reverse insertion of the retainer 118, the insertion of the retainer 118 from the correct direction is ensured.

Further, the present embodiment can be changed, and variations are possible within the technical scope of the second aspect of the present invention.

For example, the invention can be applied as long as a pre-existing portion other than the terminal insertion member 1A is used for stopping the retainer 118, and the purpose for which the connector is used, the shape of the housing, etc., are not relevant. Furthermore whilst a case concerning a female connector is described, the invention is equally applicable in the case of a male connector.

We claim:

1. An electrical connector assembly comprising a first connector and a second connector, the first connector having a first terminal and a short circuit terminal biased into electrical contact at a contact point with said first terminal, the second connector having a second terminal for connection with said first terminal and an insertion member for insertion between the short circuit terminal and first terminal in an insertion direction to break electrical contact therebetween, the short circuit terminal having an abutment spaced from the contact point for engagement by a first part of the insertion member to separate the contact point and the first terminal, said abutment having an arcuate surface which curves generally about an axis perpendicular to the insertion direction to contact said first part of said insertion member and thereby facilitate sliding engagement between said abutment and said first part of the insertion member, a second part of the insertion member being of insulative material and movable between the contact point and first terminal when separated, and said first part of said insertion member extending forward of said second part and being spaced from said second part in a direction perpendicular to the insertion direction and away from the first terminal.

2. An assembly according to claim 1 in which the short circuit terminal is formed from a resilient electrically conductive material.

3. An assembly according to claim 2 in which the short circuit terminal comprises first and second spaced apart legs.

4. An assembly according to claim 1 in which the short circuit terminal comprises first and second spaced apart legs.

5. An assembly according to claim 4 in which said first leg includes an upstanding projection engageable with said second leg to limit movement of the second leg towards the first leg.

6. An assembly according to claim 4 and further including an anti-entanglement projection on one of said legs and adapted to close the gap between the free ends of said legs.

7. An assembly according to claim 4 in which the first leg is mounted on a support surface of the first connector and the second leg carries the contact point.

8. An assembly according to claim 7 in which a mid portion of said second leg is divided into two limbs, a contact point being provided on each limb.

9. An assembly according to claim 8 in which the end portion of said second leg comprises said abutment.

10. An assembly according to claim 9 in which said legs extend in substantially parallel planes, the end portion of the second leg being perpendicular to said planes and defining said abutment between the first leg and the contact points.

11. An assembly according to claim 1 wherein the first part of said insertion member comprises an inducing surface for engagement with said abutment, the surface being tapered in the insertion direction.

12. An assembly according to claim 11 wherein the second part of said insertion member comprises a lateral arm projecting to the side and perpendicular to said insertion direction.

13. An assembly according to claim 12 wherein lateral arm projects on either side of said insertion member.

14. An assembly according to claim 12 wherein said lateral arm is to the rear of said insertion member in the insertion direction.

15. An assembly according to claim 1 wherein said insertion member is a plastics moulding.

16. An assembly according to claim 15 wherein said first connector includes a first chamber to receive said first terminal, a second chamber to receive said short circuit terminal, and a third chamber to receive a retainer to fix said first terminal, the third chamber connecting the first and second chambers and being substantially perpendicular thereto, wherein said retainer includes resilient retention means engageable in the second chamber to hold the retainer in said third chamber and permit the retainer to be moved through said third chamber from an inactive to an active condition.

17. An assembly according to claim 1 wherein said first connector includes a first chamber to receive said first terminal, a second chamber to receive said short circuit terminal, and a third chamber to receive a retainer to fix said first terminal, the third chamber connecting the first and second chambers and being substantially perpendicular thereto, wherein said retainer includes resilient retention means engageable in the second chamber to hold the retainer in said third chamber and permit the retainer to be moved through said third chamber from an inactive to an active condition.

18. An assembly according to claim 17 wherein said retention means comprise opposed projections of said retainer, the projections being arranged to hold said retainer in either the inactive or active condition.

19. An assembly according to claim 18 wherein said retainer includes an orientation projection on one side thereof and said third chamber includes an orientation recess on one side thereof, said orientation projection and orientation recess co-operating in use to ensure correct orientation of said retainer in said third chamber.

* * * * *